United States Patent [19]

Susumu

[11] 4,416,209

[45] Nov. 22, 1983

[54] METHOD FOR STITCHING ORNAMENTAL LETTERS BY SEWING MACHINE

[75] Inventor: Hanyu Susumu, Hachioji, Japan

[73] Assignee: Janome Sewing Machine Industry Co., Ltd., Japan

[21] Appl. No.: 256,429

[22] Filed: Apr. 22, 1981

[30] Foreign Application Priority Data

May 10, 1980 [JP] Japan ..... 55-61256

[51] Int. Cl.[3] ..... D05C 5/04

[52] U.S. Cl. ..... 112/266.1

[58] Field of Search ..... 112/266.1, 262.1, 158 E, 112/158 R, 158 B, 158 A, 158 D, 102, 103, 78

[56] References Cited

U.S. PATENT DOCUMENTS 3,516,373 6/1970 Maeda ..... 112/102

4,116,144 9/1978 Tanimoto et al. ..... 112/158 E 4,144,827 3/1979 Brown ..... 112/158 E 4,325,315 4/1982 Totino et al. ..... 112/266.1

*Primary Examiner*—Peter P. Nerbun

*Attorney, Agent, or Firm*—William A. Drucker

[57] ABSTRACT

When stitching ornamental letters by a sewing machine being incorporated with a memory storing stitch control data for controlling the stitch and including a needle and a fabric feeding device for producing a selected pattern of stitches, the width and the height of the letter are formed in the same direction with the fabric feeding movement of the feeding device and the lateral swinging movement of the needle, respectively. The fabric feeding movement of the feeding device is applied intermittently to the stitches forming the letter. The letters may be continuously stitched in series.

2 Claims, 3 Drawing Figures

FIG. 1
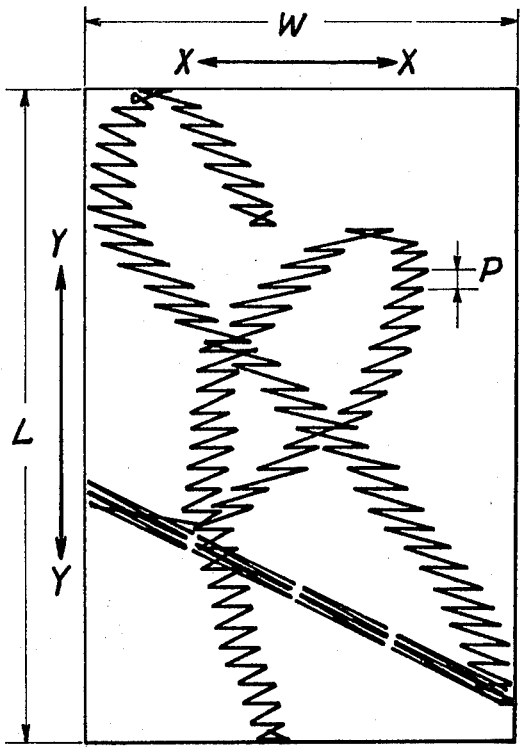
FIG. 2
Prior Art
FIG. 3 PRIOR ART
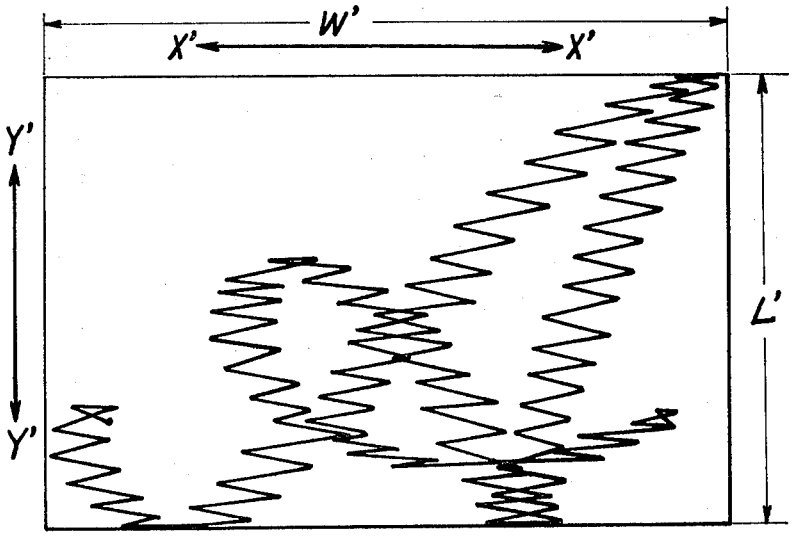

METHOD FOR STITCHING ORNAMENTAL LETTERS BY SEWING MACHINE

BACKGROUND OF INVENTION

The invention relates to a method for stitching patterns, especially for stitching ornamental letters by a sewing machine which is incorporated with a memory storing stitch control data for controlling the stitch to be sewn.

FIG. 3 shows one example of ornamental letter produced by the conventional method using the same type of sewing machine. As shown, the ornamental letter is stitched in such manner that the width X'—X' thereof is formed in the same direction with the lateral swinging movement of the needle and the height Y'—Y' thereof is formed in the same direction with the feeding movement of the fabric feeding device.

As is well known, if the sewing machine is so structured as to provide too much amplitude of the needle swinging transversely of the fabric feeding direction, the property of the sewing machine is generally deteriorated in the straight and other basic stitching operations because of the problem of catching the thread loop by the hook of a loop taker. It is therefore not preferable to enlarge the maximum amplitude W' too much. Accordingly, in case a series of ornamental letters are stitched, it is required to displace the fabric with respect to the needle with interruption of the stitching operation each time one pattern is stitched up, so as to suitably connect the first stitch of the following letter to the last stitch of the preceding letter. It is, however, difficult and time consuming to suitably stitch a series of letters. In any event, the pattern stitching operation is interrupted too many times when a series of ornamental letters are stitched. Further, according to the conventional stitching method, the fabric feeding pitches tend to be minimized for the purpose of giving a letter appearance to the ornamental letters, and such a minimum feeding operation of the feeding device often results in an undesirable formation of stitches due to the property of the fabric feeding device.

SUMMARY OF INVENTION

An object of the invention is therefore to provide a method of stitching ornamental letters which can serve to eliminate the defects and disadvantages of the prior art method.

Another object of the invention is to provide a method of stitching ornamental letters which is usable with convenience and facility by any one to stitch any letters, irrespective of the width thereof.

It is another object of the invention to provide a method of stitching ornamental letters which is usable to continuously produce a series of ornamental letters most naturally without interruption of the stitching operation.

In these aspects, according to the invention there is provided the method of stitching ornamental letters wherein the letters are stitched in such manner that the width of the letter is formed in the same direction with the fabric feeding movement of the feeding device and the height of the letter is formed in the same direction with the lateral swinging movement of the needle, said fabric feeding movement of the feeding device being applied intermittently to the stitches forming the letter.

BRIEF DESCRIPTION OF DRAWINGS

Further objects and advantages of the present invention can be more fully understood from the following detailed description when read in conjunction with the accompanying drawings, in which;

FIG. 1 is a view, on an enlarged scale, showing one example of an ornamental letter stitched according to the method of the present invention;

FIG. 2 is a view, on an enlarged scale, showing a series of ornamental letters by way of example which are continuously stitched according to the method of the present invention; and FIG. 3 is a view, on an enlarged scale, showing a letter which is the same as shown in FIG. 1 but is stitched according to the prior art method.

DETAILED DESCRIPTION OF INVENTION

With reference to FIG. 1 showing a letter "A" of alphabet stitched in accordance to the method of the invention, the letter is stitched in such manner that the width Y—Y of the letter is formed in the same direction with the fabric feeding movement of the feeding device and the height X—X is formed in the same direction with the lateral swinging movement of the needle. This stitching method may be effectively applied to continuously stitch a number of letters, for example, "M", "e", "m", "o", "r" and "y", in series as a word "Memory", as shown in FIG. 2, in which the junctions between adjacent two letters. The letter "A" in FIG. 1 as well as the series of letters "Memory" in FIG. 2 are stitched with application of fabric feed to every other one of the stitches, instead of applying the fabric feed to all the stitches. Namely, the stitches P are produced without the feeding operation of the fabric feeding device while the stitch between the stitches P is produced with the feeding operation of the fabric feeding device. Moreover, the fabric feeding amount is slightly more than that of the conventional stitching method for producing this kind of pattern.

By using the stitching method of the invention, the maximum amplitude W of the needle swinging can be considerably reduced in comparison with that W' of the conventional stitching method as shown in FIG. 3. The invention therefore will not deteriorate the straight and other basic stitching properties of the sewing machine. Further, according to the present invention, since the width Y—Y of the letter is formed in the same direction with the fabric feeding movement of the feeding device, a number of letters can be stitched in series and in succession as shown in FIG. 2 without interruption of the stitching operation. Thus, a series of letters are finished up in a single word without discrepancy. Further, since the fabric feed is applied to every other stitch of the letter with a feeding amount slightly much more than that normally applied to this kind of pattern in the conventional stitching method, the feeding device is operated with a constant rhythm providing a constant feeding amount, and therefore providing a beautiful appearance of stitches as a whole, which is free from deformed stitches.

What we claim is:

1. A method of stitching a series of ornamental letters with a sewing machine which is incorporated with a memory storing stitch control data for controlling a needle and a fabric feeding device to produce stitches of a selected pattern, said method comprising the steps of:

(a) producing a series of stitches in a zig-zag pattern in response to said stitch control data, (b) feeding the fabric being stitched on alternate stitches in the direction of said series of characters to form the stitches closely adjacent each other, and (c) said stitches defining the height of the letters in the direction of lateral swinging movement of the needle and the width of the letters in the direction of fabric feeding movement of the fabric feeding device, respectively.

2. The method according to claim 1 wherein a number of letters are stitched in series without interruption of the stitching operation.

* * * * *